US006232860B1

(12) United States Patent
Acevedo et al.

(10) Patent No.: US 6,232,860 B1
(45) Date of Patent: May 15, 2001

(54) ARMATURE FOR LATCHING A CIRCUIT BREAKER TRIP UNIT

(75) Inventors: Pedro Acevedo, Hormigueros, PR (US); Javier I. Larranaga, Bristol, CT (US); Joseph Criniti, New Britain, CT (US); Thomas R. Campbell, Washington, CT (US); Jose Velez, Sabana Grande, PR (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/602,788

(22) Filed: Jun. 23, 2000

(51) Int. Cl.[7] ..... H01H 9/20
(52) U.S. Cl. ..... 335/167; 335/168; 335/21
(58) Field of Search ..... 335/6–46, 167–176

(56) References Cited

U.S. PATENT DOCUMENTS

| | | | |
|---|---|---|---|
| 4,513,268 | 4/1985 | Seymour et al. | 335/35 |
| 4,698,903 | 10/1987 | Ciarcia et al. | 29/622 |
| 5,103,198 | 4/1992 | Morel et al. | 335/6 |
| 5,173,674 | 12/1992 | Pannenborg et al. | 335/35 |
| 5,182,532 | 1/1993 | Klein | 335/35 |
| 5,220,303 | 6/1993 | Pannenborg et al. | 335/167 |
| 5,225,800 | 7/1993 | Pannenborg et al. | 335/35 |
| 5,870,008 | 2/1999 | Pannenborg et al. | 335/35 |

*Primary Examiner*—Ramon M. Barrera
(74) *Attorney, Agent, or Firm*—Cantor Colburn LLP; Carl B. Horton

(57) ABSTRACT

A latching system for a circuit breaker is arranged to actuate a trip unit and interrupt circuit current upon occurrence of a short circuit or an overcurrent condition. The latching system employs an armature having a recess formed therein and a cradle having a cradle tip arranged to releasably engage the recess. A thermal magnetic trip unit is depicted within the circuit breaker for the purposes of detecting overcurrent conditions through the electric path. During current transport through the circuit breaker, the current is thermally sensed by means of the bimetal and magnetically sensed by means of the magnet. The armature rotates against the return bias of a compression spring to release the cradle tip from the recess and allow counterclockwise rotation of the contact arm. The rotation of the contact arm causes the separation of the movable and fixed contacts under the urgence of a mechanism spring.

16 Claims, 3 Drawing Sheets

ARMATURE FOR LATCHING A CIRCUIT BREAKER TRIP UNIT

BACKGROUND OF THE INVENTION

This invention relates to circuit breaker assemblies with a thermal magnetic trip unit and, more particularly, to circuit breakers utilizing an armature for latching a thermal magnetic trip unit.

Residential circuit breakers are described in U.S. Pat. No. 4,513,268 entitled "Automated Q-Line Circuit Breaker". The circuit breaker includes a thermalmagnetic trip unit that interrupts the circuit current upon occasion of so-called "instantaneous", "short time" and "long time" overcurrent conditions. The thermal response of the trip unit is provided by means of an extended bimetal, which is part of the circuit breaker internal current-carrying components, and is separate from the magnet that provides the trip unit magnetic response. The bimetal, in a sense, forms the primary winding of a current transformer with the magnet acting as the transformer core. A separately arranged armature unit responds to the magnetic flux generated by the magnet upon the occurrence of intense overcurrent faults to release the circuit breaker operating mechanism and thereby interrupt the circuit current.

U.S. Pat. No. 4,698,903, entitled "Circuit Breaker High Speed Assembly", describes a drawback to efficient high speed circuit breaker manufacture. Such a drawback is the time-consuming polishing process required on the latching surfaces. The polishing is required to minimize the amount of tripping force that must be applied to overcome the bias of the operating spring and the static friction of the latch surfaces. Although the polishing can be done in a separate pre-assembly process without affecting the actual circuit breaker assembly operation, the trip force required to overcome the mechanism spring bias and the latch surface friction depends to a certain extent upon the polishing operation. The latch surfaces are fabricated from stamped metal parts which exhibit a rough burr on the edge of one surface and a smooth die roll on the edge of the opposite surface. In the prior art, an opening through the stamped part is formed during the stamping operations. Thus, a die break is produced when the slug pushes into the die during the stamping operation and can tear the work material and consequently produce a rough surface. A rough surface is not suitable for latching as it leads to unpredictable performance between the latching surfaces and is a high friction area. Further, high friction does not lend itself to permit smooth and quick disengagement of the latched part from the latch surface.

In an attempt to reduce the primary latch friction, without requiring either polishing or shaving during the circuit breaker assembly operation, a highly polished shim insert was positioned within the armature-latch arrangement in an offline assembly described in the aforementioned U.S. Pat. No. 4,513,268. The insert was in the form of a highly polished stainless steel shim that was welded or brazed within the cradle retaining slot formed in the armature-latch component. It would be economically advantageous to eliminate the on-line shaving process and to eliminate the off-line polished shim insert without affecting the circuit breaker trip response.

Therefore, it is desirable to provide an armature latch that substantially reduces the static friction existing between the latch surfaces without requiring any shaving or shim insertion operations whatsoever.

BRIEF SUMMARY OF THE INVENTION

In an exemplary embodiment of the invention, a latching system for a circuit breaker is arranged to actuate a trip unit and interrupt circuit current upon occurrence of a short circuit or an overcurrent condition. The latching system employs an armature having a recess formed therein and a cradle having a cradle tip arranged to releasably engage a first side of the recess. The armature is arranged to move upon an overcurrent condition thus causing the cradle tip to be released from the recess.

A thermal-magnetic trip unit is depicted within the circuit breaker for the purposes of detecting overcurrent conditions through the electric path. During current transport through the circuit breaker, the current is thermally sensed by means of the bimetal and magnetically sensed by means of the magnet. The armature rotates to release the cradle tip from the recess and allow counterclockwise rotation of the contact arm. The rotation of the contact arm causes the separation of the movable and fixed contacts under the urgence of a mechanism spring.

DETAILED DESCRIPTION OF THE INVENTION

Figure 1:
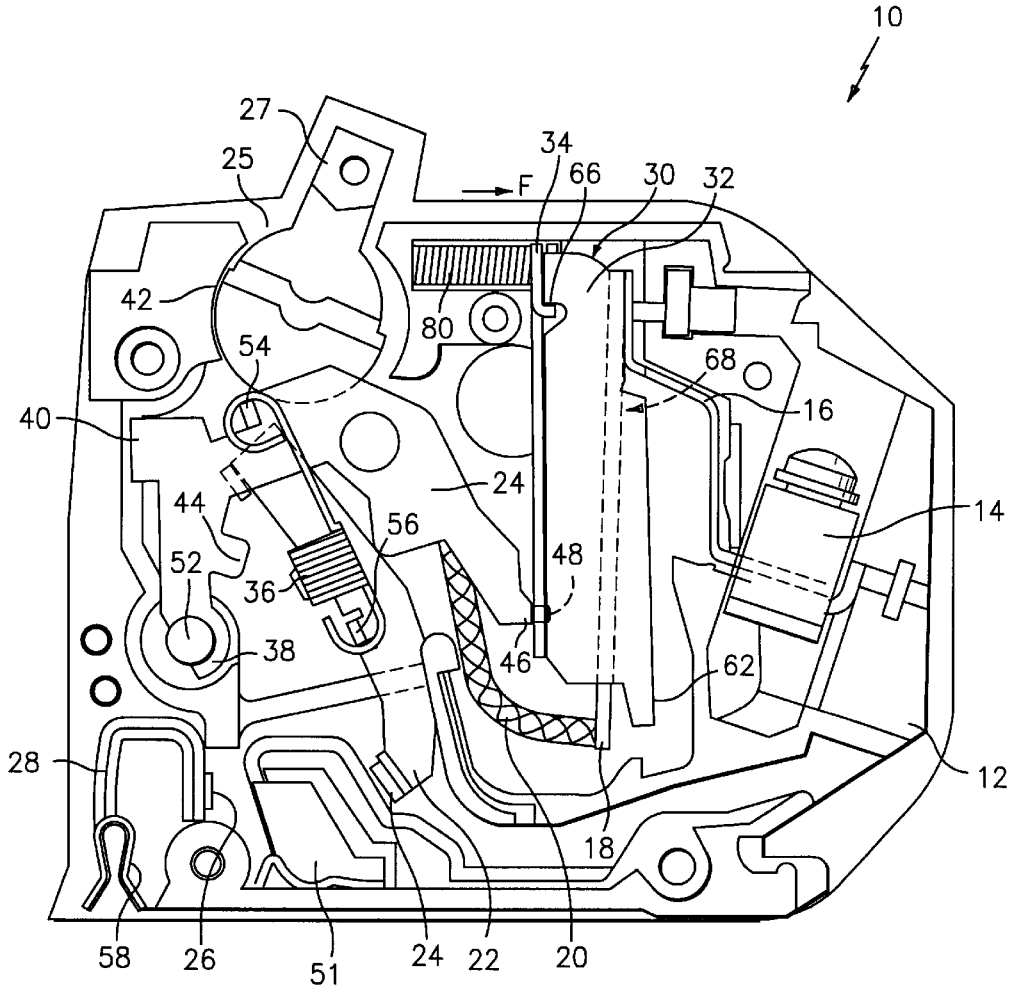
FIG. 1 is an internal front side view of a circuit breaker according to an embodiment of the present invention.

Referring to FIG. 1, a residential type circuit breaker 10 is shown in the OPEN position and consists of a molded plastic case 12 with a load terminal lug 14 arranged at one end. Although a residential circuit breaker is shown, the use of commercial or industrial circuit breakers, as well as other types of residential circuit breakers, is within the scope of this invention. An operating handle 27 extends through an opening 25 in the case 12. The operating handle 27 is movable between OFF and ON positions. Moving the operating handle 27 to the OFF position separates a fixed contact 26 from a movable contact 24. Thus, the flow of electrical current through the circuit breaker 10 is stopped when the operating handle 27 is in the OFF position. Moving the operating handle 27 to the ON position brings the fixed and movable contacts 26, 24 into contact to allow the electrical current to flow through the fixed and movable contacts 26, 24 to a protected load.

In the ON position, the current path proceeds from the load terminal lug 14 through a load strap 16, a current carrying bimetal (bimetal) 18, and a braid conductor (conductor) 20 to a movable contact arm 22 that supports movable contact 24 at one end. The electrical path is completed through fixed contact 26, which engages an external electric circuit by means of a line terminal stab 28. The circuit current transfers between the fixed and movable contacts 26, 24 until an overcurrent condition is sensed by means of the bimetal 18 or a magnetic trip unit 30.

Figure 2:
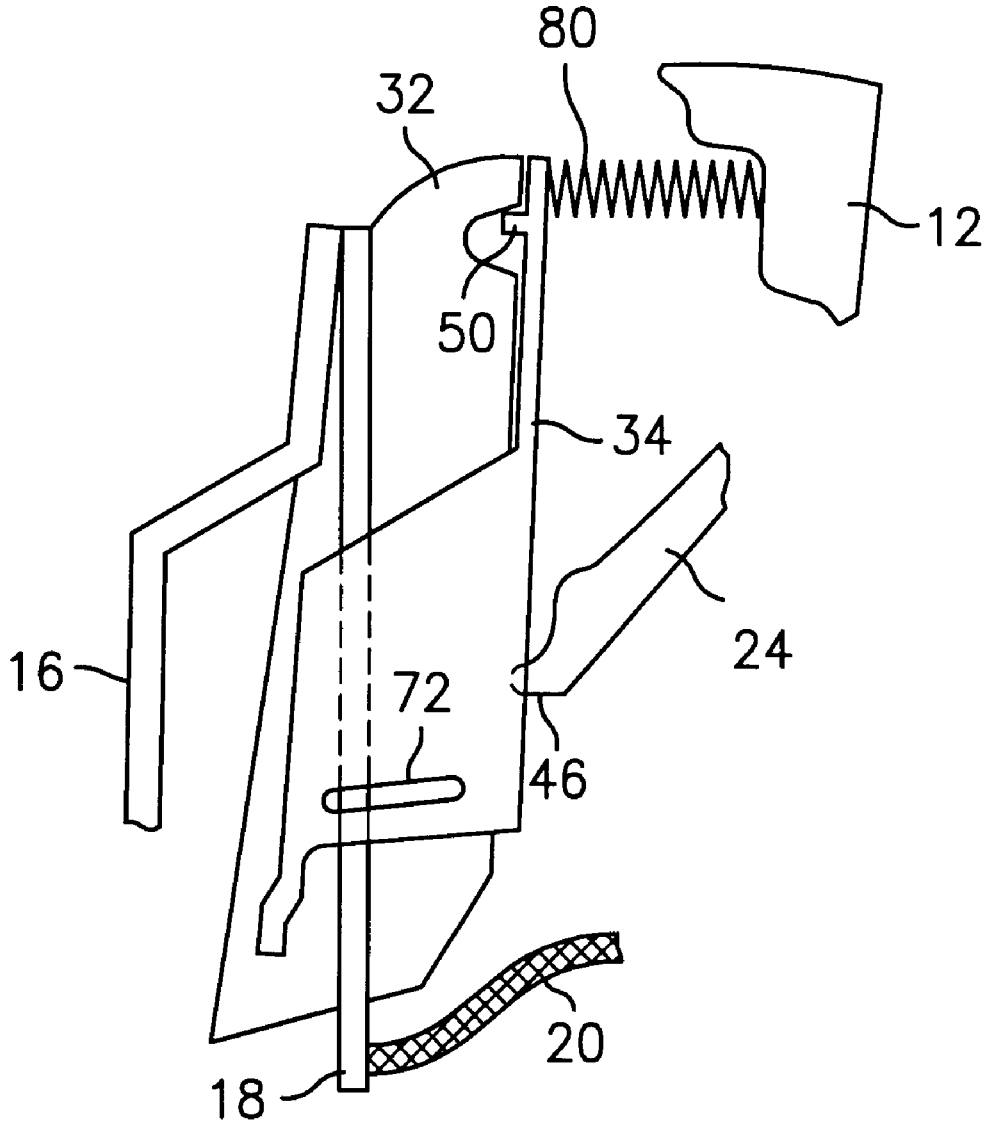
FIG. 2 is a rear side view of the armature, bimetal and magnet embodied by the present invention.

Referring to FIGS. 1 and 2, bimetal 18 is welded or brazed at one end to the top part of the load strap 16. The opposite end of the bimetal 18 is welded or brazed to one end of the braid conductor 20. The opposite end of the braid conductor 20 is welded or brazed to the movable contact arm 22. The magnetic trip unit 30 includes a magnet 32 that interacts with an armature 34 that is pivotally arranged within the case 12. The armature 34 and the magnet 32 are positioned at the top of the case 12 and are held together by means of a compression spring (spring) 80. The magnet 32 is press-fitted into a slot (not shown) within the case 12 between the bimetal 18 and the load strap 16. The magnet 32 is shaped to provide a structure, preferably L-shaped, in order to surround the bimetal 18. A pair of tabs 50 is positioned on the armature 34 and provides a pivot for the armature 34.

Referring again to FIG. 1, a latching system, shown generally at 68, comprises a cradle 23 and the armature 34. Cradle 23 is formed from a single Ushaped body configuration formed to include a radiused end 38. Radiused end 38 is pivotally secured in a hemispherical recess (not shown) formed within the case 12 for allowing the cradle 23 to rotate between a latched position (shown in FIG. 1) to an unlatched position about a cradle pivot 52. An offset tab 40 at one end of the top part of the cradle 23 interacts with one part of a shoulder 42 integrally formed with the operating handle 27. A tab 44 extending parallel and opposite offset tab 40 interacts with an opposite part of the shoulder 42 when the operating handle 27 is moved between the ON and OFF positions. A cradle tip 46 is located at an end of the cradle 23 opposite the end where the radiused end 38.

In the completed circuit breaker 10, the line terminal stab 28, a stab spring 58 and fixed contact 26 are arranged within a slot (not shown) within the case 12. An arc chute 51 is shown located intermediate the fixed and movable contacts 26, 24. A mechanism spring 36 is supported by means of a spring tab 56 on the contact arm 22 and a spring tab 54 on cradle 23. Spring tabs 54, 56 move with the cradle 23 and contact arm 22. When the circuit breaker contacts 24, 26 are in the closed position, the mechanism spring 36 provides pressure on the cradle tip 46 to maintain engagement within a recess 48 of armature 34. This pressure ensures the movable contact 24 maintains contact with the fixed contact 26 thus preventing nuisance tripping.

Figure 3:
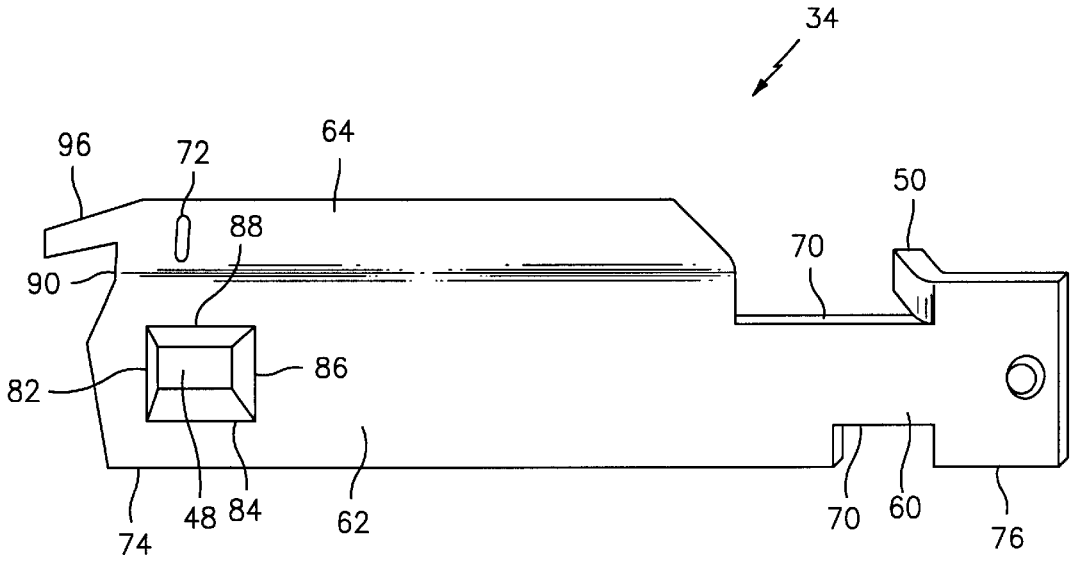
FIG. 3 is an isometric view of the armature and recess embodied by the present invention.

Referring to FIG. 3, armature 34 is formed from a single piece of steel, having a first section 62 and a second section 64 having a first end 90. First section 62 includes a first end 74 and a second end 76. Second section 64 includes a first end 90 proximate to first end 74 of first section 62. The second section 64 is integral with the first section 62 and extends generally perpendicular from the first section 62. Preferably, the armature 34 is generally L-shaped for promoting magnetic transfer between the armature 34 and the magnet 32. The first section contains a narrow top portion 60 having two notches 70 for which are press-fitted into corresponding slots (not shown) within case 12 (FIG. 1). Tabs 50 are located proximate to the second end 76 of first section 62. Tabs 50 project outward, preferably perpendicular, from the first section 62. At the first end 74 of the first section 62, recess 48 is formed. A conventional die stamping process forms the recess 48. Preferably, the recess 48 forms a four-sided depression on one side of the first section 62 and a protrusion (not shown) on the opposite side of the flat bottom piece 62, preferably protruding in the same general direction as the tabs 50. At the first end 90 of second section 64, leg 96 extends in a direction parallel to second section 64. Preferably, leg 96 is angled inward and positioned proximate to the bimetal 18. Proximate to the leg 96 and located on second section 64 is an elongated, depression 72.

Recess 48 has a first side 82, a second side 84, a third side 86 and a fourth side 88. First side 82 is formed by stamping the first section 62 of armature 34 to about ninety percent of the -first section 62. First side 82 is fabricated with a straight edge, preferably perpendicular with the flat bottom piece 62. Second side 84 is inwardly beveled, preferably at a forty-five degree angle. Second side is located adjacent to the first side 82. Third and fourth sides 86, 88 are also inwardly beveled, preferably at a forty-five degree angle. Third side 84 is located adjacent to the second side 84 and opposite the first side 82. Fourth side 88 is located between the first and third sides 82, 86. First, second, third and fourth sides 82, 84, 86, 88 form the sides of the recess 48. The cradle tip 46 is releasably engaged within recess 48. The surface of the first side 82 that engages the cradle tip 46 is smooth and straight minimizing friction between the cradle tip 46 and the surface of the first side 82 of the armature 34. A smooth surface thus permits the cradle tip 46 to smoothly and quickly slide away from the recess 48. The depth of the recess 48 ensures that the cradle tip 46 sufficiently engages within the recess 48.

Figure 4:
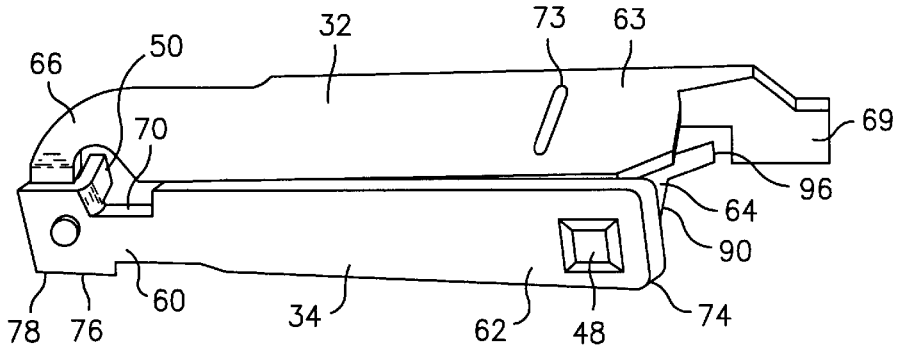
FIG. 4 is an isometric view of a magnet and an armature embodied by the present invention.

Referring to FIG. 4, the armature 34 and magnet 32 are shown in detail. The magnet 32 includes an angled top piece 66 integral with a flat bottom piece 63 and an angled bottom piece 69. Angled top piece 66 is positioned between a slot (not shown) within case 12 (FIG. 1) and one end of the armature 34 and rests on tabs 50 of the armature 34. Spring 80 is pressed against a protrusion 78 located on first section 62 of the armature 34. Protrusion 78 is located proximate the tabs 50 of the armature 34. Spring 80 defines a line of force "F", designated by an arrow, "F", acting on the armature 34 and the magnet 32 at a predetermined point of contact indicated by protrusion 78. Thus, spring 80 supports the magnet 32 and the armature 34 within the case 12 (FIG. 1). The angled bottom piece 69 of the magnet 32 cooperates with the first section 62 and the second section 64 of the armature 34 to provide a closed magnetic loop which increase the magnetic coupling between the armature 34 and the magnet 32. An elongated depression 73 is formed in the flat bottom piece 63. Depression 73 of magnet 32 and depression 72 of armature 34 provide a bearing surface to the bimetal 18 as the bimetal 18 deflects during an overcurrent condition.

Referring to FIGS. 1 and 2, the operation of the armature 34 during a trip event will now be described in detail. A thermal-magnetic trip unit is depicted within the circuit breaker 10 for the purposes of detecting overcurrent conditions through the electric path. During current transport through the circuit breaker 10, the current is thermally sensed by means of the bimetal 18 and magnetically sensed by means of the magnet 32.

The thermal portion of the thermal-magnetic trip unit utilizes cradle 23 that is biased by mechanism spring 36 in a counterclockwise direction about cradle pivot 52. The armature 34 is biased in a clockwise direction (shown in FIG. 1) by spring 80. The engagement of the cradle tip 46 within recess 48 prevents the cradle 23 from rotating, thus maintaining the movable contact 24 of the contact arm 22 in contact with the fixed contact 26. When movable contact 24 is in contact with fixed contact 26 a current path through circuit breaker 10 is created.

When an overcurrent condition occurs, the temperature of the bimetal 18 increases due to the current passing through the bimetal 18. If the temperature of the bimetal 18 increases sufficiently due to the overcurrent condition thus exceeding a predefined current level, the bimetal 18 will deflect from an initial position and engage the leg 96 of the armature 34. The armature 34 rotates in a counterclockwise direction in response to the force of the bimetal 18 applied to the leg 96. The armature 34 moves in a direction away from cradle 23 thereby displacing the cradle tip 46 out of the recess 48. The cradle 23 is thus released from the recess 48 and rotates in a clockwise direction thereby releasing the mechanism spring 36. The mechanism spring 36, once released, rapidly pulls the contact arm 22 and movable contact 24 away from the fixed contact 26. Thus, the current through the circuit is interrupted.

The magnetic trip portion of the thermal-magnetic trip unit includes the armature 34 and magnet 32. Upon the occurrence of a "short time" overcurrent condition of a predetermined magnitude and duration, the armature 34 is magnetically drawn towards the magnet 32 in a direction away from cradle 23. The cradle tip 46 is displaced out of the recess 48. The cradle 23 is thus released from the recess 48 and rotates in a clockwise direction thereby releasing the mechanism spring 36. The mechanism spring 36, once released, rapidly pulls the contact arm 22 and movable contact 24 away from the fixed contact 26. Thus, the current through the circuit is interrupted.

When the circuit breaker is not under overcurrent of short circuit conditions, the movable and fixed contacts 24, 26 can be separated by manually moving the operating handle 27. Under short circuit or overcurrent conditions, the thermal magnetic trip unit will trip the circuit breaker 10 and unlatch the latching system 68 as described herein above. To re-latch the circuit breaker 10, the operating handle 27 is manually moved to the OFF position and then back to the ON position. The operation of the operating handle 27 to the OFF position resets the cradle tip 46 within the recess 48 of the armature 34. The motion of the operating handle 27 to the ON position will bias the mechanism spring 36 forcing the cradle tip 46 to engage the recess 48.

As described herein, the recess 48 is fabricated with a straight die punch in a conventional steel stamping process. The first side 82 of the recess 48 provides an even surface for engagement with the cradle tip 46. Thus, a superior material surface area is achieved for the latching surface. The second, third and fourth sides 84, 86, 88 of the recess 48 are beveled and ensure the structural integrity of the recess 48. Therefore, all the advantages inherent in the recess 48 contribute to reliable latching forces that ensure that the circuit breaker 10 will trip at all designed overcurrent levels. To assist with the slippage of the cradle tip 46 from the recess 48, grease is applied to the recess 48 and will be retained within the recess 48 for extended use. Finally, the recess 48 of the armature 34 does not require any additional calibration or post processing machining operations. Once the recess 48 is formed in the armature 34, the armature 34 is ready to be assembled into the circuit breaker 10.

It is within the scope of this invention and understood by those skilled in the art that the armature 34 and recess 48 can be utilized with various magnet 32 and bimetal 18 configurations within a trip unit.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments failings within the scope of the appended claims.

What is claimed is:

1. A latching system suitable for actuating a thermal magnetic trip unit to trip a circuit breaker upon an overcurrent condition, the latching system comprising;

an armature having a recess formed therein, wherein said armature being arranged to move upon the overcurrent condition; and a cradle having a cradle tip arranged to releasably engage from said recess, wherein movement of said armature in response to the overcurrent condition releases said cradle tip from said recess.

2. The latching system of claim 1 wherein said recess includes:

a first side, said cradle tip releasably engaging said first side;

a second side positioned adjacent to said first side;

a third side positioned adjacent to said second side and opposite said first side; and a fourth side positioned between said first and third sides.

3. The latching system of claim 2 wherein said second, third and fourth sides are inwardly beveled.

4. The latching system of claim 2 wherein said armature being formed from a single L-shaped metal piece having a first section and a second section, said recess formed in said first section proximate a first end.

5. The latching system of claim 4 wherein said first side of said recess is perpendicular to said first section of said armature.

6. The latching system of claim 4 further including:

a magnet having an angled top piece positioned proximate to a second end of said first section of said armature and an angled bottom piece positioned proximate said second section of said armature, wherein said armature is attracted to said magnet during a short circuit condition thereby releasing said cradle tip from said recess.

7. The latching system of claim 6 wherein said magnet is formed from a single L-shaped metal piece.

8. The latching system of claim 6 further including:

a bimetal positioned between said magnet and said armature; and said armature includes:

a leg extending from a first end of said second section of said armature;

wherein said bimetal pivots said leg of said armature in response to an overcurrent condition thereby releasing said cradle tip from said recess.

9. A circuit breaker comprising:

a molded case;

a fixed contact and a moveable contact arranged within said case to separate upon an overcurrent condition, said moveable contact being arranged at one end of a moveable contact arm and said fixed contact electrically connected to a line terminal stab;

a trip unit configured to separate said fixed and movable contacts; and a latching system including:

an armature having a recess formed therein, wherein said armature being arranged to move upon the overcurrent condition; and a cradle having a cradle tip arranged to releasably engage from recess, wherein movement of said armature in response to the overcurrent condition releases said cradle tip from said recess.

10. The circuit breaker of claim 9 wherein said recess includes:

a first side, said cradle tip releasably engaging said first side;

a second side positioned adjacent to said first side;

a third side positioned adjacent to said second side and opposite said first side; and a fourth side positioned between said first and third sides.

11. The circuit breaker of claim 10 wherein said second, third and fourth sides are inwardly beveled.

12. The circuit breaker of claim 9 wherein said armature being formed from a single L-shaped metal piece having a first section and a second section, said recess formed in said first section proximate a first end.

13. The circuit breaker of claim 12 wherein said first side of said recess is perpendicular to said first section of said armature.

14. The circuit breaker of claim 12 further including:

a magnet having an angled top piece positioned proximate to a second end of said first section of said armature and an angled bottom piece positioned proximate said second section of said armature, wherein said armature is attracted to said magnet during a short circuit condition thereby releasing said cradle tip from said recess.

15. The circuit breaker of claim 14 wherein said magnet is formed from a single L-shaped metal piece.

16. The circuit breaker of claim 14 further including:

a bimetal positioned between said magnet and said armature; and saqid armature includes:

a leg extending from a first end of said second section of said armature;

wherein said bimetal pivots said leg of said armature in response to an overcurrent condition thereby releasing said cradle tip from said recess.

* * * * *